US010513366B2

(12) United States Patent
Jacobsson et al.

(10) Patent No.: US 10,513,366 B2
(45) Date of Patent: Dec. 24, 2019

(54) PACKAGING CONTAINER WITH GRIPPING SUPPORT SURFACE

(71) Applicant: Tetra Laval Holdings & Finance S.A., Pully (CH)

(72) Inventors: Kristian Jacobsson, Dalby (SE); Fredrik Ahlström, Höllviken (SE); Andreas Larsson, Dalby (SE); Oliver Keller, Hamburg (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 93 days.

(21) Appl. No.: 15/737,732

(22) PCT Filed: Jun. 9, 2016

(86) PCT No.: PCT/EP2016/063216
§ 371 (c)(1),
(2) Date: Dec. 18, 2017

(87) PCT Pub. No.: WO2016/202684
PCT Pub. Date: Dec. 22, 2016

(65) Prior Publication Data

US 2018/0178943 A1 Jun. 28, 2018

(30) Foreign Application Priority Data

Jun. 18, 2015 (SE) ..... 1550856

(51) Int. Cl.
*B65D 5/42* (2006.01)
*B65D 8/00* (2006.01)
(Continued)

(52) U.S. Cl.
CPC ..... *B65D 5/4208* (2013.01); *B65D 5/061* (2013.01); *B65D 5/12* (2013.01); *B65D 5/46072* (2013.01); *B65D 5/746* (2013.01); *B65D 15/22* (2013.01)

(58) Field of Classification Search
CPC ..... B65D 5/067; B65D 5/029; B65D 3/08; B65D 5/746
See application file for complete search history.

(56) References Cited

U.S. PATENT DOCUMENTS 1,995,703 A * 3/1935 Clark ..... B65D 1/0207 118/DIG. 3
3,924,797 A * 12/1975 Furbeck ..... B65D 5/46088 229/117.13
(Continued)

FOREIGN PATENT DOCUMENTS

EP 2371722 10/2011
EP 2552791 2/2013
(Continued)

OTHER PUBLICATIONS

International Search Report and Written Opinion for International Application No. PCT/EP2016/063216 dated Aug. 3, 2016 in 11 pages.
(Continued)

*Primary Examiner* — Brian D Nash
(74) *Attorney, Agent, or Firm* — Knobbe, Martens, Olson & Bear, LLP

(57) ABSTRACT

A packaging container may include a top part with a pouring spout for pouring the contents of the container. The packaging container may further include a tubular body part with an upper end and a lower end, the upper end being joined together with the top part along a circumferential edge of the upper end of the body part. The body part may further include a first group of crease lines extending from a lower
(Continued)

end of the body part towards its upper end. The top part may include a recessed portion, the recessed portion and the first group visually forming one surface. A surface near the interface area between the first group of crease lines and the recessed portion of the top part may provide gripping support for one or more fingers of a hand when the packaging container is held by the hand and the remaining fingers while pouring the contents from the packaging container.

12 Claims, 5 Drawing Sheets

(51) Int. Cl.

| | |
|---|---|
| ***B65D 5/74*** | (2006.01) |
| ***B65D 5/06*** | (2006.01) |
| ***B65D 5/12*** | (2006.01) |
| ***B65D 5/46*** | (2006.01) |

(56) References Cited

U.S. PATENT DOCUMENTS

| | | | | | |
|---|---|---|---|---|---|
| D244,993 | S | * | 7/1977 | Drysdale | D9/432 |
| 4,527,699 | A | * | 7/1985 | Namba | B65D 15/22 215/12.2 |
| 4,564,139 | A | * | 1/1986 | Reil | B65D 3/02 222/530 |
| 4,730,766 | A | * | 3/1988 | Fear | B65D 5/067 229/106 |
| 4,830,273 | A | * | 5/1989 | Kalberer | B65D 5/068 220/265 |
| 4,846,396 | A | | 7/1989 | Palazzolo | |
| 4,848,601 | A | | 7/1989 | Reil | |
| 5,000,375 | A | * | 3/1991 | Farber | B65D 5/4208 229/116.1 |
| D329,595 | S | * | 9/1992 | Kung | D9/520 |
| D364,815 | S | * | 12/1995 | Wallace | D9/782 |
| 5,531,375 | A | * | 7/1996 | Palm | B65D 5/029 229/137 |
| D391,847 | S | * | 3/1998 | Seo | D9/417 |
| 5,738,272 | A | * | 4/1998 | Anchor | B65D 5/029 229/109 |
| 5,803,349 | A | * | 9/1998 | Ljungstrom | B65D 5/068 229/125.42 |
| 5,938,107 | A | * | 8/1999 | Anchor | B65D 3/08 229/109 |
| 6,027,016 | A | * | 2/2000 | Ljungstrom | B65D 5/029 229/109 |
| D436,033 | S | * | 1/2001 | Croft | D9/541 |
| D469,691 | S | * | 2/2003 | Brondyke | D9/422 |
| D494,861 | S | * | 8/2004 | Guidotti | D9/431 |
| D511,454 | S | * | 11/2005 | Stillerud | D9/560 |
| D540,164 | S | * | 4/2007 | Franic | D9/434 |
| D554,509 | S | * | 11/2007 | Ghalebi | D9/520 |
| D570,683 | S | * | 6/2008 | Kortsmit | D9/431 |
| 7,523,853 | B2 | * | 4/2009 | Kortsmit | B65D 5/067 229/108 |
| 7,726,503 | B2 | * | 6/2010 | Dygert | B65D 1/20 215/398 |
| D702,117 | S | * | 4/2014 | Dagnino | D9/417 |
| D733,556 | S | * | 7/2015 | De Pietri Tonelli | D9/431 |
| 2005/0236463 | A1 | * | 10/2005 | Boldrini | B65D 5/067 229/100 |
| 2006/0144912 | A1 | * | 7/2006 | Franic | B65D 5/029 229/125.15 |
| 2008/0277460 | A1 | * | 11/2008 | Mohn | B65D 3/08 229/108 |
| 2008/0296359 | A1 | * | 12/2008 | Kortsmit | B65D 5/067 229/136 |
| 2011/0113733 | A1 | * | 5/2011 | Franic | B65D 5/029 53/452 |
| 2013/0082049 | A1 | * | 4/2013 | Padain | B65D 3/08 220/4.01 |
| 2014/0001248 | A1 | | 1/2014 | Wong et al. | |
| 2015/0360819 | A1 | * | 12/2015 | Wieser | B65D 5/067 206/524.3 |

FOREIGN PATENT DOCUMENTS

| | | |
|---|---|---|
| FR | 2534880 | 4/1984 |
| JP | 10-59351 | 3/1998 |
| WO | WO 01/23260 | 4/2001 |
| WO | WO 03/086881 | 10/2003 |
| WO | WO 2005/097606 | 10/2005 |
| WO | WO 2009/101029 | 8/2009 |
| WO | WO 2010/128918 | 11/2010 |

OTHER PUBLICATIONS

International-Type Search Report for National Application No. 1550856-7 dated Feb. 2, 2016 in 5 pages.

* cited by examiner

PACKAGING CONTAINER WITH GRIPPING SUPPORT SURFACE

TECHNICAL FIELD

The present invention is related to packaging container, blanks of packaging material and a method for manufacturing a packaging container.

BACKGROUND

In the field of packaging containers for foodstuffs several types of packaging containers are well-known. Some of them have a so called gable top shape with or without a screw cap on one of the inclined surfaces forming the top part of the container. One example of such a packaging container is Tetra Rex™ which has been available on the market for many years.

Other packaging containers comprise a container having a body of fiber-based laminate and a top made of polymer with a rather large pouring spout at the top. One example of such a packaging container is Tetra Top™ and is also widely available on the market today.

These packaging containers are made from blanks of carton based material comprising several inner and outer layers of polymer which are laminated together in a lamination apparatus and provided with weakening lines or crease lines along which a converting machine raises the packaging container. In the case of Tetra Rex™ the container is made of the packaging material laminate entirely, while in the case of Tetra Top™ the top part is injection moulded onto a raised tube made from the packaging material laminate.

In the standard version packaging containers are gripped around the circumference of the packaging container when foodstuffs in the container are to be poured out. It would thus be desirable to provide an improved container grip preventing accidental slipping during pouring and improving the handling of the container when being held by a consumer. Also, it would be desirable to improve upon the pouring experience of the consumer.

One solution is provided by US-patent application 2014/0001248 A1 published on 2 Jan. 2014 and filed in the name of the application. The US-application discloses a package for enclosing a liquid food product comprising an area having a tactile pattern for at least indicating intended user grip and/or enhancing decor graphics. Moreover, a blank, a reel of blanks and a method for generating the tactile pattern is disclosed. Although providing solid grip during pouring the contents of the package, the tactile pattern is best held by the consumer by gripping it on each side where the tactile pattern is located.

One other solution is disclosed in the international patent application WO 2005/097606 where a gable top package comprises a gripping arrangement extending over the side and back panel parts of the package intended to be held by the hand of a consumer.

Besides having some aesthetical drawbacks this solution would also naturally introduce bulging in the package, making it difficult to stand on a shelf side by side with other gable-top packages.

Despite the existing solutions described earlier, it would be desirable to provide an aesthetically appealing package which at the same time provides firm grip support when being held and which may improve the pouring experience for the consumer.

SUMMARY OF THE INVENTION

At least some of the problems identified in the prior art are solved by a container, blank and method for forming a container according to the independent claims.

The scope of the invention is defined by the appended claims.

Thus, according to one aspect of the present invention, a solution comprises a packaging container according to independent claim 1. The packaging container comprises:

- a top part comprising a pouring spout for pouring the contents of the container;
- a tubular body part comprising an upper end and a lower end, the upper end being joined together with the top part along a circumferential edge of the upper end of the body part, the body part further comprising a first group of crease lines extending from a lower end of the body part towards its upper end, wherein the top part comprises a recessed portion and where the recessed portion and the first group visually form one surface, wherein the one surface near the interface area between the first group of crease lines and the recessed portion of the top part provides gripping support for one or more fingers of a hand, when the packaging container is held by the hand and the remaining fingers during pouring the contents from the packaging container.

In this fashion a packaging container is provided which provides improved grip support when being held in the hand of a consumer during pouring, a better pouring experience and also a visually appealing experience.

According to another aspect of the present invention the solution is provided by a blank of packaging material. The blank of packaging material comprises a body and a base portion, the body portion having parallel panels divided by a group of parallel crease lines extending from one end of the body portion, the base portion comprising bottom crease lines forming the bottom portion of a container raised from the blank, wherein a first group of non-parallel crease lines extends from one end of the body portion towards the opposite end of the body portion, the first group of crease lines forming a surface providing gripping support for one or more fingers of a hand when pouring contents from a packaging container raised from the blank.

The blank of packaging material described above is especially suitable to be used in order to raise a packaging container described in earlier paragraphs.

Finally, according to yet another aspect of the present invention the solution is provided by a method for manufacturing a packaging container. The method comprises:

- receiving a blank of packaging material,
- raising a packaging container from the blank by folding it along parallel crease lines portion thus forming a body portion;
- injection moulding a top portion of the packaging container onto an upper part of the raised container, such that the top portion and the body portion are joined along the upper edge of the body portion
- filling the raised packaging container with foodstuffs and;
- sealing the bottom of the container by folding it along its bottom crease lines.

The method described above is especially suitable for manufacturing a packaging container described in earlier paragraphs using the blank of packaging material described earlier.

DETAILED DESCRIPTION

Before turning to the detailed part of the description of the preferred examples it should be pointed out that the examples described herein are described for illustration purposes only and should not be construed as limiting the invention in any way. Ultimately, the invention is only limited by the appended claims.

Figure 1A:
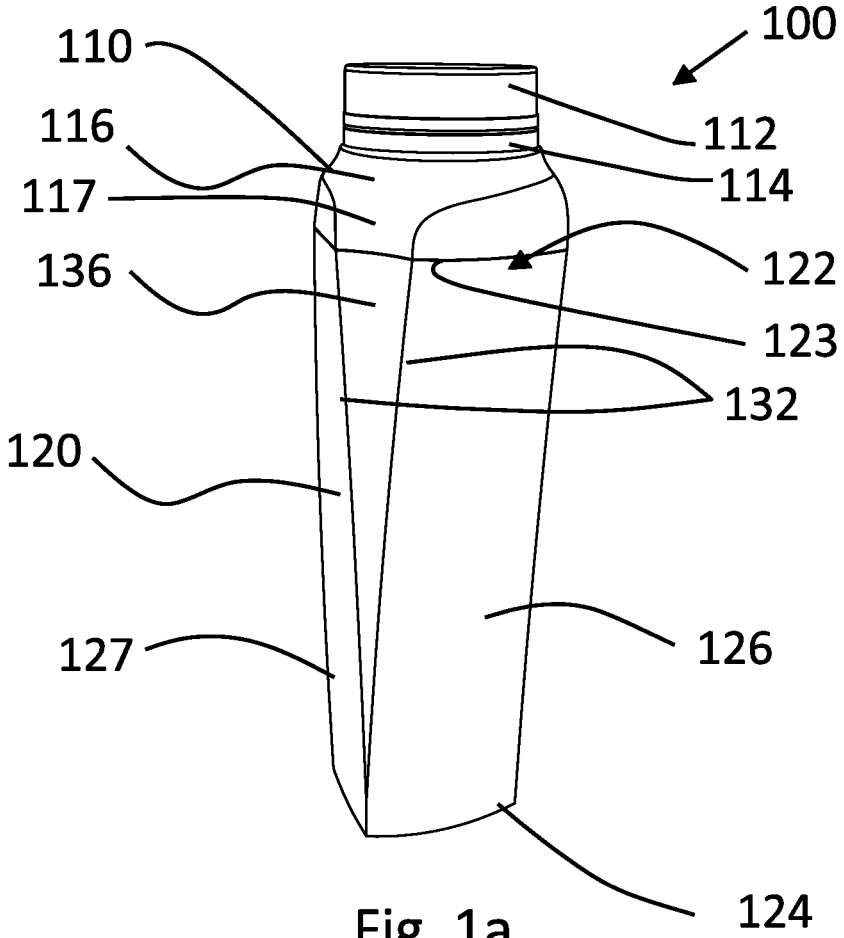
FIG. 1A illustrates a container according to one example of the present invention from a perspective view.
Figure 1B:
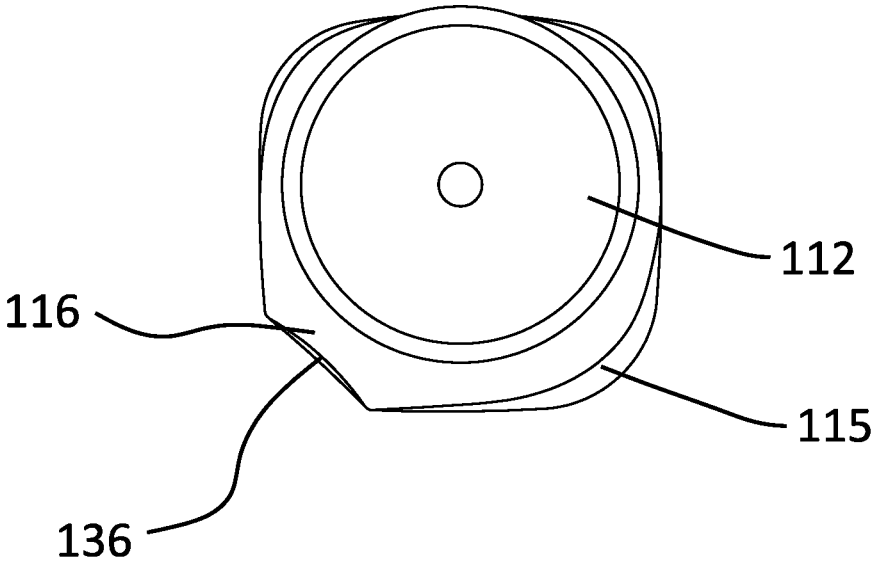
FIG. 1B illustrates the container form FIG. 1A from a top view.

FIG. 1 discloses a container 100 according to one example of the present invention. The container comprises a top part 110 and body part 120 which are joined together along a circumferential edge 123 of the body part 120 located in the upper end 122 of the same.

In the example in FIG. 1 the top part 110 further comprises a screw cap 112 with a tamper ring 114 which indicates whether the container has previously been opened or not. Although not illustrated, the screw cap comprises threads on the inside surface of its annular portion which engage a neck portion (not shown) on the top part 110 with complementary threads for the purpose of closing the package.

Moreover, the top part 110 further comprises a contoured portion 116 with a recess 117 forming a sloping surface.

The top part 110 may be injection moulded onto the edge 123 of the body 120 or joined with the body in some other way, such as adhesion.

The body part 120 is preferably raised from a carton blank having a laminated structure with a polymer film on both sides of the carton layer. The laminate may also comprise an oxygen barrier layer, such as aluminium foil. As can be seen from the figure, the body part 120 comprises several panels folded along several parallel crease lines 134. These crease lines extend from a lower end 124 of the body part 120 towards the upper end 122.

In the example shown in FIG. 1 a pair of diverging crease lines 132 originating at a lower left corner of the first panel 126 and extending towards the upper end 122 of the body 120 delimit a surface which visually extends into the surface formed by the recess in the top part 110 of the container 100.

Besides providing the container with a pleasing aesthetical appearance, the surface delimited by the diverging crease lines 132 together with the sloping surface formed by the recess 117 provide a grip support for the consumer when holding the container for the purpose of pouring out the foodstuff container therein. Especially when the consumer holds the container such that the thumb or some other supporting finger is placed either on the upper portion of the surface 136 or on the interface between the surface 136 and the surface formed by the recess 117 in the top a firm grip on the container will be obtained resulting in an improved pouring experience. The recess 117 may also be adjusted in size to match the shape of an average sized human thumb.

Although the gripping support surface 136 is located between two panels 126 and 127 of the container 100, it may equally be located on one panel only. It would be preferable in that case that the visual impression of a common surface between the one formed by the recess 117 in the top part 110 and the one formed by the diverging crease lines 132 is maintained as in the example illustrated in FIG. 1. Moreover, the crease 132 may not necessarily originate in one point but may extend from two opposite corners of the same panel of the body part 120 and converge at the upper end 122 of the body. In one other variant, the crease lines may originate at different locations at the lower end 124 of the body part 120 and converge towards the upper end 122 of the body part 120. Moreover, there may be several gripping support surfaces located on the top 110 and body parts 120 delimited by different groups of crease lines.

In order to enhance the stability of the container on a flat surface, the lower end 124 of the body part 120 may be curved as shown in FIG. 1

Figure 2:
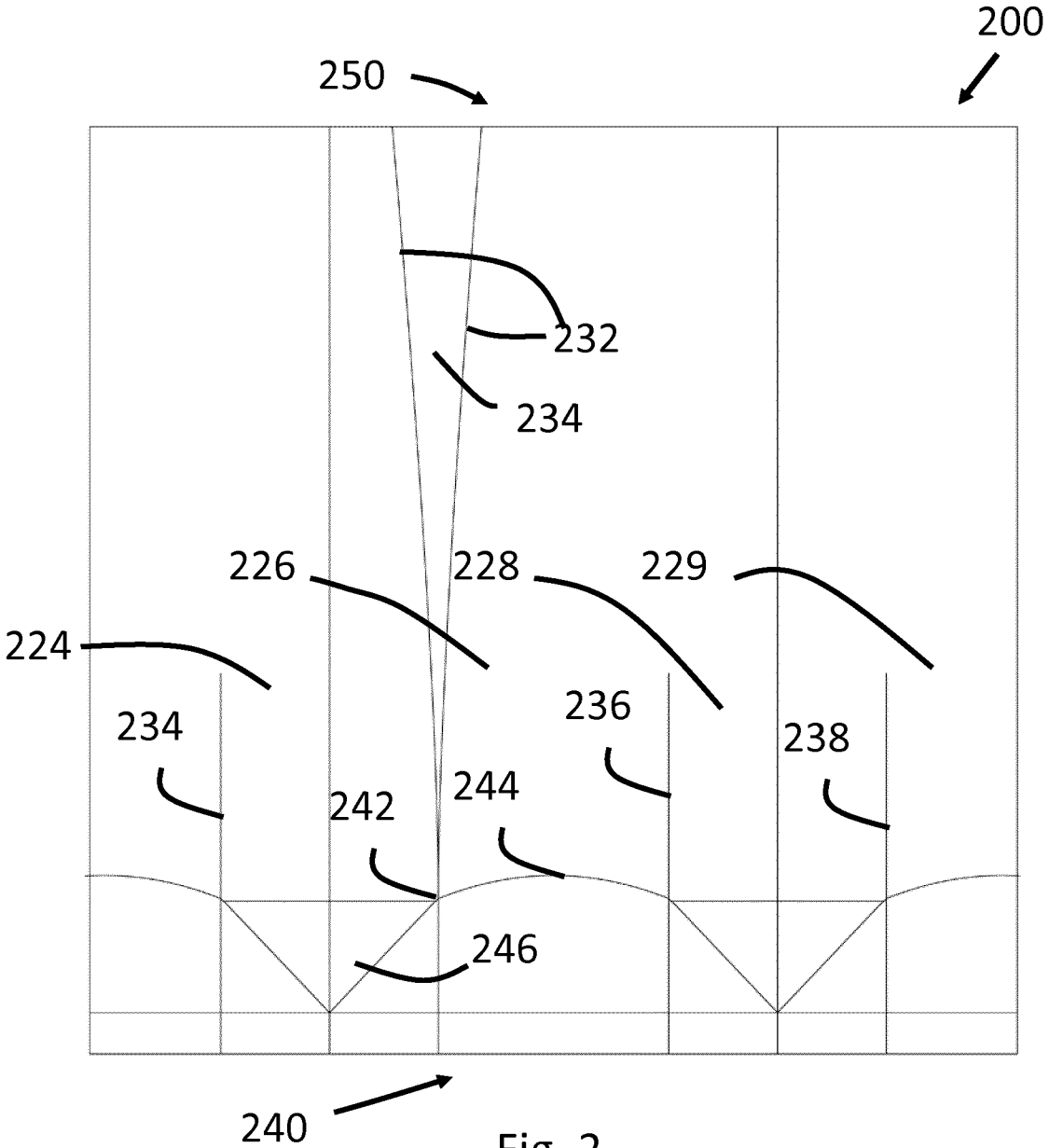
FIG. 2 illustrates a blank of packaging material according to a first example of the present invention.

FIG. 2 displays a blank 200 of packaging material suitable to be raised into a body part of a container, such as the container illustrated in FIG. 1.

The blank comprises several first 225, second 226, third 228 and fourth 229, where one half of the fourth panel 229 is displayed on the right hand side and the other half of the left-hand side. The edges of the fourth panel 229 will be eventually sealed in a sealing apparatus forming a tube of packaging material from the blank 200. Moreover, several vertical and parallel crease lines 234, 236 and 238 are displayed along which the blank is going to be folded later, such that the first 224, second 226, third 228 and fourth 229 panels form the four sides of the body part of a container, such as the container 100 in FIG. 1. Also, a bottom part of the blank 200 contains bottom crease lines 246, 244 along which the bottom section of the raised container will be formed. In the intersection between the first 224 and second panel 226 a first group of non-parallel crease lines 232 extends, such that they originate from a common point bottom part 240 of the blank 200 and diverge towards the upper end 250 of it. These diverging crease lines 232 delimit a surface 234 providing gripping support for one or more fingers of a consumer holding a container with a body portion raised from the blank 200. These crease lines 232 may not only improve the ergonomic aspects of gripping a container raised form the blank, but also provided for an aesthetic effect especially when visually forming a single surface with a surface provided by the recess in the top part of such a container. An example of such a container is shown in FIG. 1.

The non-parallel crease lines 232 may be formed by a pair of die rollers carrying the crease line pattern illustrated in FIG. 2, where the packaging laminate is passed between one male and one female die.

Besides the non-parallel crease lines 232 other decorative crease lines (not shown) may be present adding to the aesthetic appeal of the raised container. The decorative crease lines may originate from the same point 242 as the two to grip support crease lines 232 or at some other point along the lower end 240 of the blank 200 and extend to the upper end 250 of the same.

Figure 3:
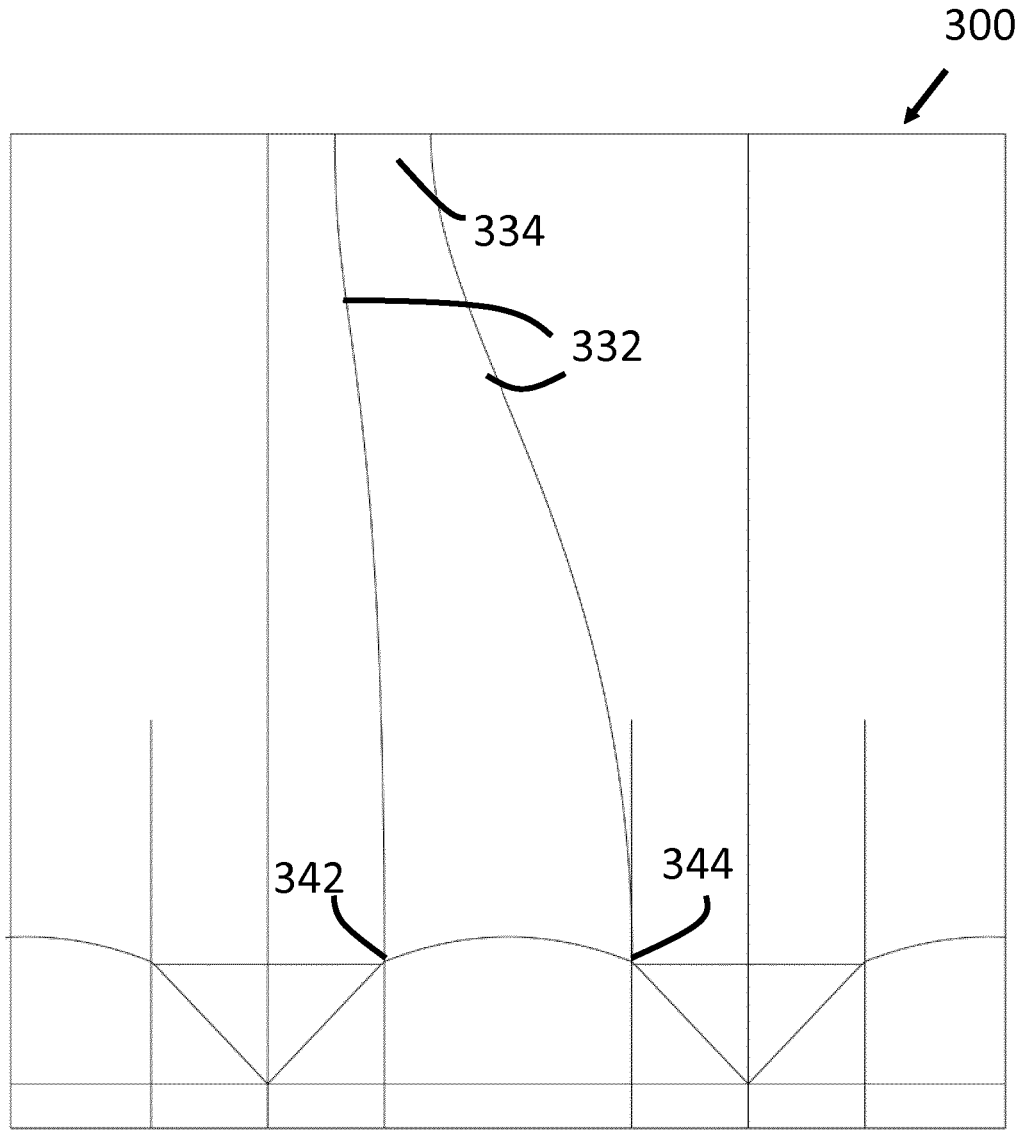
FIG. 3 illustrates a blank of packaging material according to a second example of the present invention.

FIG. 3 illustrates another example of a blank 300 of packaging material according to the present invention. In this example, the non parallel crease lines 332 extend from two opposite corners 342, 344 of the bottom portion of the same panel towards the upper end. Together, these non-parallel crease lines delimit a gripping support surface 334 onto which one or more fingers can be put when holding a container raised from the blank 300. The difference between the example in FIG. 3 and the one in FIG. 2 is that the gripping support surface 334 is located almost entirely within the second panel. Since the top part of a container raised form such a blank should have a recess visually forming one surface with the gripping support surface 334, the recess on the top part will be somewhat shifted compared to example in FIG. 2. The gripping support functionality is not changed however.

Figure 4:
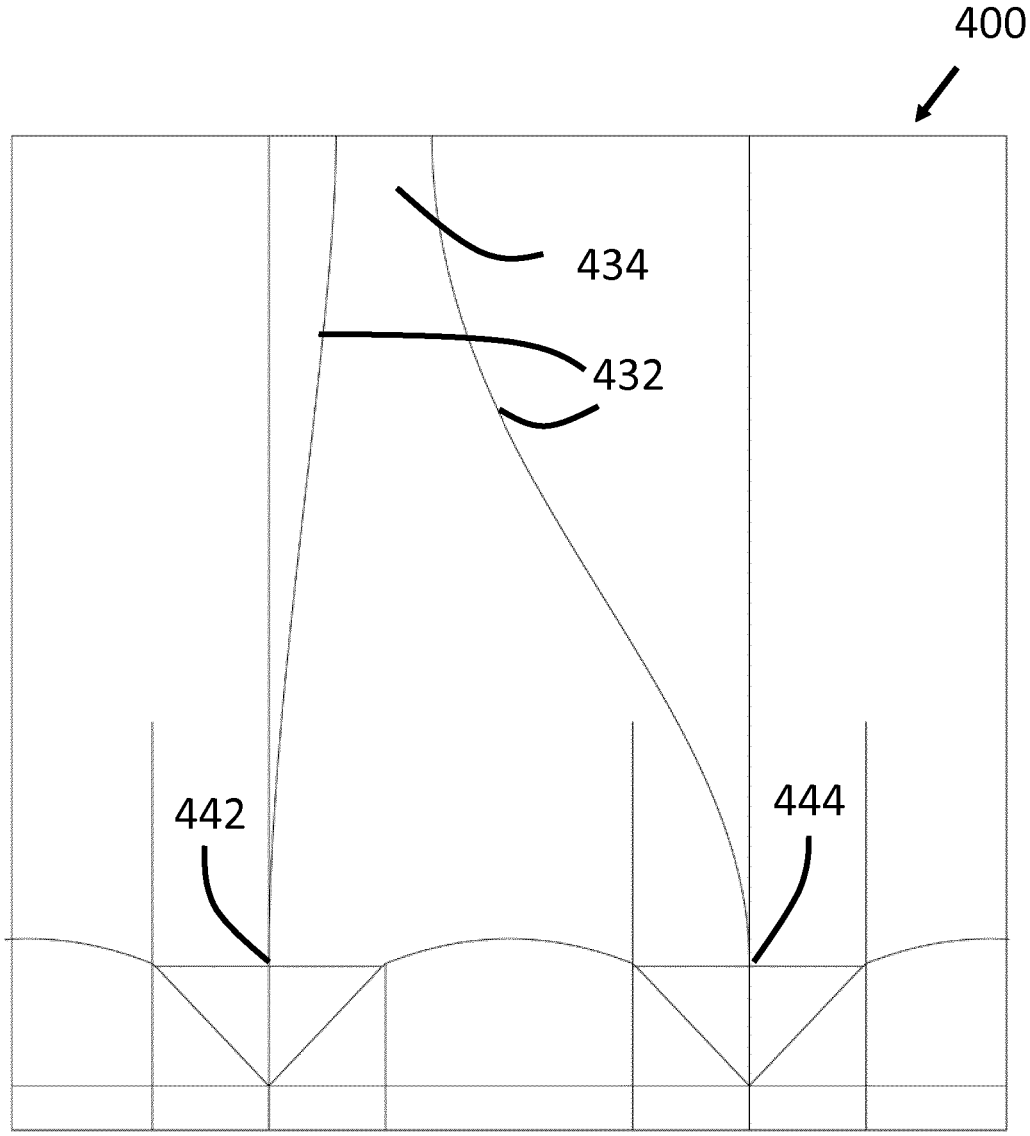
FIG. 4 illustrates a blank of packaging material according to a third example of the present invention.

FIG. 4 illustrates a third example of a blank 400 of packaging material where the non-parallel crease lines start at two corners 442 and 444 of two different panels (i.e. first and third panels) and form a gripping support surface 434 in similar ways as already illustrated in FIGS. 2 and 3. When holding a container raised from the blank 400 by putting a thumb or other fingers on the gripping support surface 434, the remaining part of the hand may rest on lower portion of the gripping support surface 434. This example may thus offer increased gripping support.

Figure 5:
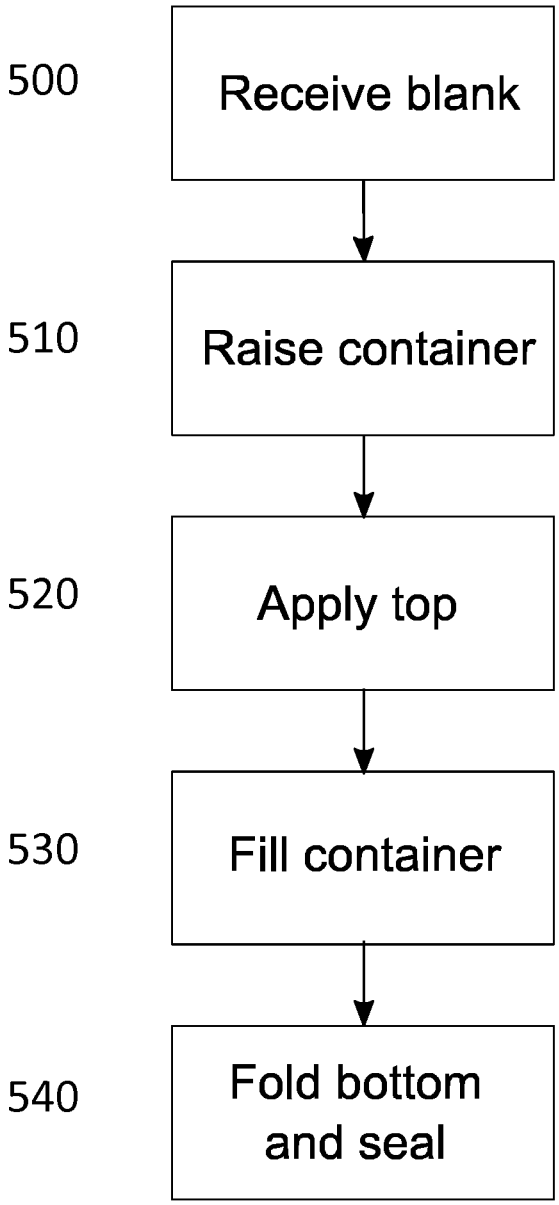
FIG. 5 displays a flow chart illustrating the steps of a method according to one example of the present invention.

FIG. 5 illustrates a flowchart characterizing the steps performed by an example of the method according to the present invention. It should be mentioned that the order of the steps may not be necessarily limited to the ones illustrated in FIG. 5.

At step 500 a blank of fiber material, such as a carton blank is received in a conversion apparatus. It is assumed here that the crease line pattern, such as the crease line patterns illustrated in FIGS. 2-4 is already present on the blank.

Next, at step 510 the conversion apparatus produces a tube of packaging material by raising the package from the blank and by sealing the ends of two longitudinal panels to each other.

Using the crease line patterns from one of the blanks the conversion apparatus will also form the gripping support surface as described in FIG. 1.

At the next step 520 a top part is applied to the tube of packaging material which may be manufactured from polymer material. It can be either injection moulded onto the edge of the tube, where the tube is placed on a conical mandrel before injection or manufactured in a mould.

Whatever the case, the top part is manufactured to have a contoured part described in FIG. 1A forming a surface which visually should form one surface with the gripping support surface delimited by the non-parallel crease lines on the tube. Also, a threaded neck portion is produced in the same step 520 onto which a threaded screw cap with complementary threads may be applied. In this way the container is closed.

In the next step 530 the almost finished container is filled with the foodstuff that is to be contained therein, while being positioned upside-down in the apparatus, i.e. the bottom section facing a filling valve while the top sections is closed by a screw cap attached to a tamper ring. Once the container is filled with the foodstuff, a folding mechanism folds the bottom part of the container by along the bottom crease lines described earlier and performs a sealing operation for the side flaps seen in the blanks in FIGS. 2-4.

The result of all method steps 500-540 is a packaging container which may look like the one displayed in FIG. 1A depending on the blank of packaging material used.

As will be evident to the skilled person who has studied the above description, there are more possible examples of the packaging container, blank and method than the one described in the above text. Ultimately, the present invention is only limited by the appended claims.

The invention claimed is:

1. A packaging container comprising:

a tubular body part formed separately from the top part, the tubular body part comprising an upper end and a lower end, the upper end of the tubular body part joined together with the top part tubular body part joined with the top part along a circumferential edge of the upper end of the tubular body part, the tubular body part further comprising a first group of crease lines extending from the lower end of the tubular body part toward the upper end of the tubular body part;

wherein the top part comprises a recessed portion, the recessed portion and the first group of crease lines configured to visually appear as a single surface, wherein a gripping portion positioned near the interface between the first group of crease lines and the recessed portion of the top part is configured to provide gripping support for one or more fingers of a hand when the container is held by the hand while pouring contents from the container; and wherein the first group of crease lines start at a common point near or at the lower end of the body part.

2. The packaging container according to claim 1, wherein the top part comprises a polymer material.

3. The packaging container according to claim 1, wherein the tubular body part comprises a fiber based material.

4. The packaging container according to claim 1, wherein the tubular body part is formed from a blank of packaging material.

5. The packaging container according to claim 1, wherein the body comprises a plurality of panels, the panels being at least partly delimited by a second group of crease lines.

6. The packaging container according to claim 5, wherein the first group of crease lines extend from a lower end of a first panel and diverge into a top part of a second panel.

7. The packaging container according to claim 5, wherein the first group of crease lines extend from a lower end of a first panel and converge into a top part of a second panel.

8. A blank of packaging material comprising:

a body portion and a base portion, the body portion comprising parallel panels divided by a group of parallel crease lines extending from one end of the body portion, the base portion comprising bottom crease lines forming the bottom portion of a container formed from the blank, wherein a first group of non-parallel crease lines extends from the one end of the body portion towards an opposite end of the body portion, the first group of crease lines forming a surface configured to provide gripping support for one or more fingers of a hand when pouring contents from the container; and wherein the first group of crease lines originate at a common point at the one end of the body portion and diverge towards and terminate at two different points at the opposite end of the blank.

9. The blank according to claim 8, wherein the first group of crease lines originate at different locations at the one end of the body portion and diverge towards the opposite side of the body portion.

10. The blank according to claim 9, wherein the first group of crease lines originate from the same panel.

11. The blank according to claim 9, wherein the first group of crease lines originate from different panels.

12. A method for manufacturing a packaging container, comprising:

receiving a blank of packaging material according to claim 8;

forming a packaging container from the blank by folding it along the parallel crease lines portion thus forming a body portion;

forming a top portion of the packaging container by injection moulding onto an upper part of the raised container, such that the top portion and the body portion are joined along the upper edge of the body portion filling the raised packaging container with foodstuffs; and sealing the bottom of the container by folding it along its bottom crease lines.

* * * * *